United States Patent [19]

Johnston et al.

[11] Patent Number: 4,534,635

[45] Date of Patent: Aug. 13, 1985

[54] METHOD AND APPARATUS FOR CONVEYING A FLEXIBLE, IMPERFORATE MEMBER THROUGH A FLUID

[76] Inventors: Gary M. Johnston, 2444 Hihiwai 1001, Honolulu, Hi. 96826; Leonard A. Ciupak, 1133 Makaiwa St., Honolulu, Hi. 96816

[21] Appl. No.: 551,124

[22] Filed: Nov. 14, 1983

[51] Int. Cl.[3] ..... G03D 3/02; G03D 3/12

[52] U.S. Cl. ..... 354/322; 354/324; 134/64 P

[58] Field of Search ..... 354/316, 319, 320, 321, 354/322, 324, 325; 134/64 P, 122 P

[56] References Cited

U.S. PATENT DOCUMENTS

| | | | |
|---|---|---|---|
| 3,311,039 | 3/1967 | Lucas | 354/324 |
| 3,741,093 | 6/1973 | Komori et al. | 354/321 |
| 3,860,944 | 1/1975 | Huber et al. | 354/324 |
| 4,003,070 | 1/1977 | Merz | 354/322 |
| 4,208,121 | 6/1980 | Muller | 354/320 |

FOREIGN PATENT DOCUMENTS

| | | | |
|---|---|---|---|
| 1548152 | 11/1968 | France | 354/321 |

*Primary Examiner*—A. A. Mathews

*Attorney, Agent, or Firm*—Stanley J. Price, Jr.

[57] ABSTRACT

The apparatus has a support member with a surface that has a pervious portion. The support member is positioned in a tank or container of liquid. A flexible carrier member with a pervious portion is positioned in overlying relation with the surface of the support member. A flexible, impervious photographic material is positioned on the flexible carrier member and a suction is applied through the pervious portion of the support member surface and through the pervious portion of the flexible carrier member to engage the flexible, impervious photographic material on the flexible carrier member. The flexible carrier member with the flexible, impervious photographic material engaged thereto is conveyed on the surface of the support member through the liquid bath.

8 Claims, 8 Drawing Figures

METHOD AND APPARATUS FOR CONVEYING A FLEXIBLE, IMPERFORATE MEMBER THROUGH A FLUID

BACKGROUND OF THE INVENTION

1. Field of the Invention

This invention relates to a method and apparatus for conveying a flexible, imperforate member through a liquid and, more particularly, to a method and apparatus for conveying a photographic material through a liquid or a series of liquids in a photographic development process.

2. Description of the Prior Art

Photographic paper or photographic film is generally made up of a base onto which an emulsion is coated. The base is primarily composed of a plastic material. The emulsion coating on the base is substantially a gel which is light sensitive. Usually, the gel consists of several layers with each layer being sensitive to a certain wave length of light or a certain color of light.

Prior to the gel or emulsion being exposed to various liquid chemical baths in photographic processing, the gel or emulsion is relatively sturdy and is not very susceptible to damage through normal handling. When this emulsion, however, is subjected to a series of liquid chemical baths, such as in photographic processing, the emulsion becomes very soft. In its soft state, this emulsion can scratch easily. Therefore, extreme care must be taken in photographic processing to avoid scratching of or damage to the photographic film or photographic paper. For example, a slight scratch on a negative can cause a large scratch on an enlarged print that is made from that negative.

Additionally, care must be taken in the particular photographic process to insure that the photographic paper or photographic film does not become significantly overdeveloped or underdeveloped in the various chemical baths. Further, in most present photographic processing apparatus, careful monitoring during the development process must be maintained to avoid loss or damage to the photographic film or photographic paper from causes inherently related to a particular apparatus.

One of the commonly known devices used in photographic processing is the roller transport processor. In this processor, a plurality of rollers are positioned in each of the various tanks containing the various liquid chemical baths of a photographic process. The photographic paper or photographic film is fed between pairs of driven rollers and the rollers convey the photographic paper or photographic film through a liquid chemical bath. In most cases, a U-shaped configuration of roller pairs is used in each liquid chemical bath of a photographic process. Using such a U-shaped configuration, the photographic paper or photographic film is pulled down through a liquid chemical bath to the bottom of a tank and then back up through the liquid chemical bath, following the U-shaped path provided by the rollers in the bath.

With the roller transport apparatus, various problems are present. If there is any foreign matter on any one of the rollers, it is likely to cause a scratch on the photographic paper or photographic film. Further, if the photographic paper or photographic film, for any number of reasons, does not proceed smoothly through a pair of rollers or a series of pairs of rollers, scratching or other physical damage to the photographic paper or photographic film can occur.

Since the time the photographic paper or photographic film is in a chemical bath may be critical to proper processing, any delay or jamming of the photographic paper or photographic film in a roller transport processor may also produce an unacceptable overdeveloping of the photographic paper or photographic film. One of the more serious problems associated with the roller transport processor, however, is that the photographic paper or photographic film could become torn or creased by the rollers. If the original photographic film is being processed and such should occur, the damage to the film may be permanent and irreversible.

In the roller transport method, a turn guide is often times employed to carry the photographic paper or photographic film from one liquid chemical bath to another liquid chemical bath. The turn guide is generally a curved piece of plastic or metal which is positioned adjacent to and between liquid chemical baths.

Other apparatus commonly used in the development of photographic film or photographic paper is commonly referred to as hanger transport devices. The photographic paper or photographic film is usually pinned to a hanger which is connected to a device for submerging and removing the photographic paper or photographic film from the various liquid chemical baths in the process.

A common problem associated with the hanger transport apparatus is that, if the photographic paper or photographic film is not properly secured to the hanger when it is lowered into a liquid chemical bath, the motion of raising or lowering may jar the photographic paper or photographic film loose so that it falls off the hanger, thereby remaining in the liquid chemical bath. If such should occur, overdevelopment of the photographic paper or photographic film in the bath occurs especially if the loss of the film from the hanger is not readily noticed.

A second problem is universally present with the hanger transport apparatus. The photographic paper or photographic film is usually arranged in a vertical manner from the hanger, and the photographic paper or photographic film generally enters and leaves a liquid chemical bath in a vertical direction. With this arrangement, the photographic paper or photographic film on the bottom hanger enters the chemical bath first and commences development prior to the photographic paper or photographic film in the middle or top of the hanger. When the photographic paper or photographic film is removed from the chemical bath, the photographic paper or photographic film near the top of the hanger leaves the bath before the middle or the bottom of the arrangement. If not carefully controlled, overdevelopment or underdevelopment or both could occur.

Other apparatus often used in photographic processing is the leader transport apparatus. The photographic paper or photographic film is either taped, stapled, clipped or attached by some appropriate means to a leader. Usually, the leader is made of plastic. The leader is driven through the chemical bath or baths in the process, usually by means of a series of rollers similar to that previously discussed. Generally, only the leader is driven and the photographic paper or photographic film, which is attached to the leader, is pulled through the chemical bath. The leader can be either an endless leader, which is in the form of a continuous belt, or could be a single piece of material which is fed through the various baths. If care is not taken to attach the photographic paper or photographic film properly to the leader, it may detach in the process. If it should detach, the photographic paper or photographic film may become damaged through possible scratching or tearing. Also, if the film should become disengaged from the leader, it may fall to the bottom of the chemical bath and may be subjected to damage from overexposure from the chemical action in the bath. It is also possible that the leader may break, causing problems similar to those mentioned above.

Examples of other photographic apparatus and methods are disclosed in the following United States patents. U.S. Pat. No. 3,690,758 to Knechtel et al. discloses a developing apparatus for electrophotographic use. The apparatus includes a tank containing developing liquid, a cylinder having an apertured side wall supported for rotation in the tank, and a propeller within the cylinder for creating reduced pressure therein. Sheets of paper having an electrostatic latent image formed thereon are attracted to the cylinder and maintained in contact therewith by suction. After development, the sheets of paper are peeled from the cylinder by elongated comb tooth members.

U.S. Pat. No. 4,003,070 to Merz et al. discloses apparatus for treating photographic materials. In Merz, a pair of drums is mounted for rotation about parallel axes. Channel forming walls are provided adjacent the drums. Such channel forming walls define a first channel section and a second channel section surrounding the circumference of the drums with the channel sections merging with one another in a gap between the drums. Circulating means is provided to circulate a treating fluid through the channel sections. The photographic material is fed sequentially through the first and second channel sections. Suction is employed to draw the photographic material against the rotating drums.

U.S. Pat. No. 4,208,121 to Muller discloses apparatus for developing latent images of X-ray objects on dielectric receptor sheets. In Muller, two identical sheet carriers constituting a segment of a cylinder and extending along an arc of less than 180° rotate about a horizontal shaft. Suction ports are provided in the peripheral surfaces of the carriers to attract the receptor sheets during rotation of the carrier.

There is need for a relatively simple, effective, and efficient method and apparatus for transporting photographic material, such as photographic film or photographic paper, through a liquid or various liquids in the photographic processing of the photographic material. Such method or apparatus should also significantly minimize damage to the photographic material from scratching, tearing or from adverse chemical action on the photographic material, such as from overexposure or underexposure.

SUMMARY OF THE INVENTION

In accordance with the present invention, there is provided apparatus for conveying a photographic material through a liquid in photographic processing that includes a container having a liquid therein and a support chamber positioned in the liquid in the container. The support member has a surface with a previous portion. A flexible carrier member is positioned in overlying relation with the support member surface. The flexible carrier member also has a pervious portion. A conveying means is provided to convey the flexible carrier member in the liquid in abutting relation with the surface of the support member with the flexible carrier pervious portion in overlying relation with the support member surface pervious portion. A suction means provides a suction through the pervious portion of the support member surface and the pervious portion of the flexible carrier in overlying relation therewith to engage a surface of a flexible, impervious photographic material to a surface of the flexible carrier member. The flexible, impervious photographic material is thereby conveyed with the flexible carrier member through the liquid and along the surface of the support member having a pervious portion.

The present invention includes a method for transporting the photographic material through a liquid bath and includes positioning a support member having a surface with a pervious portion in a container of liquid. A flexible carrier member having a pervious portion is positioned in overlying relation with the surface of the support member. A flexible, impervious photographic material is positioned on the flexible carrier member. A suction is applied through the pervious portion of the support member surface and through the pervious portion of the flexible carrier member to engage the flexible, impervious photographic material on the flexible carrier member by suction. The flexible carrier member with the flexible, impervious photographic material engaged thereto is conveyed on the surface of the support member through the liquid.

A method and apparatus is also provided to transfer the photographic material from a first source of liquid to a second source of liquid.

While the method and apparatus of the present invention are described in relation to photographic processes, such method and apparatus should not be construed in a limiting sense and may be employed to convey a flexible imperforate member through a fluid.

Accordingly, an object of the present invention is to provide a method and apparatus for conveying a flexible imperforate member through a fluid.

A further object of the present invention is to provide a method and apparatus for conveying a photographic material through a liquid bath in photographic processing that can substantially minimize problems associated with scratching or tearing of the photographic material while being conveyed through a liquid bath.

An additional object of the present invention is to provide a method and apparatus in photographic processing which can substantially reduce or eliminate problems associated with adverse chemical action on the photographic material, such as overexposure or underexposure of the photographic material to chemical action in a liquid bath, as the photographic material is conveyed through the liquid bath.

These and other objects of the present invention will be more completely discussed and described in the following specification, the accompanying drawings, and the appended claims.

DESCRIPTION OF THE PREFERRED EMBODIMENTS

Figure 1:
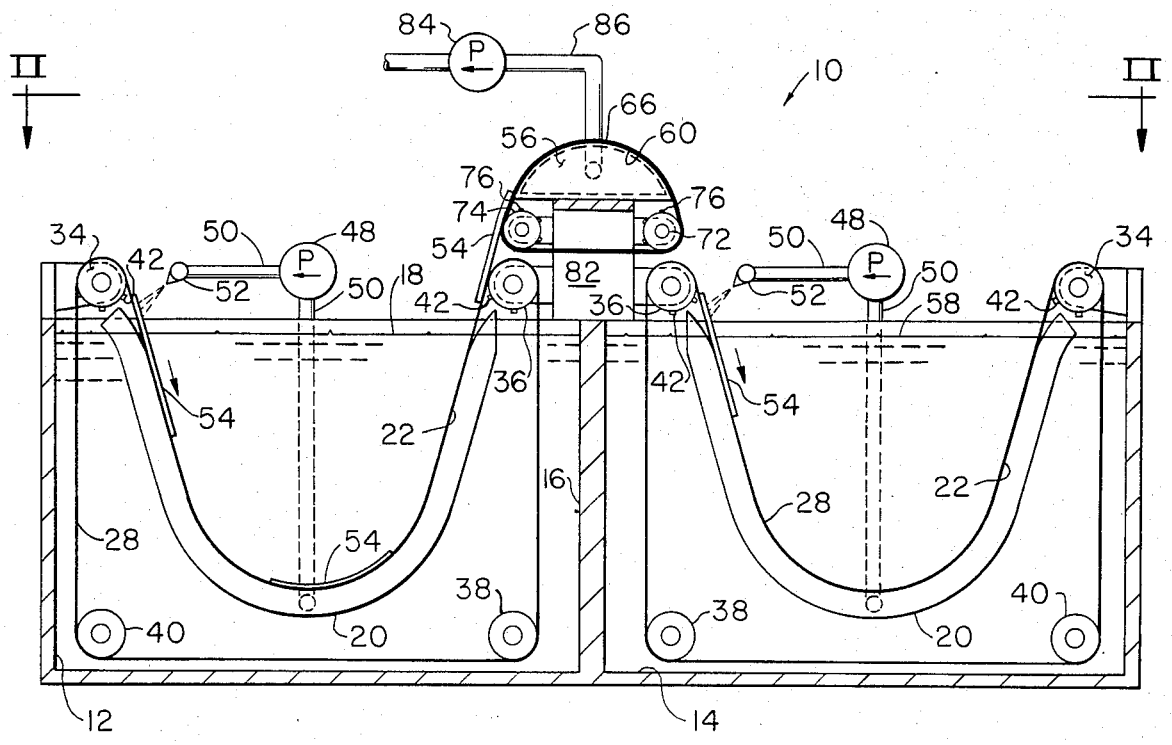
FIG. 1 is a elevational view showing the apparatus of the present invention for conveying a flexible, imperforate member, such as a photographic material, through two containers having a liquid therein with the containers shown in section.
Figure 2:
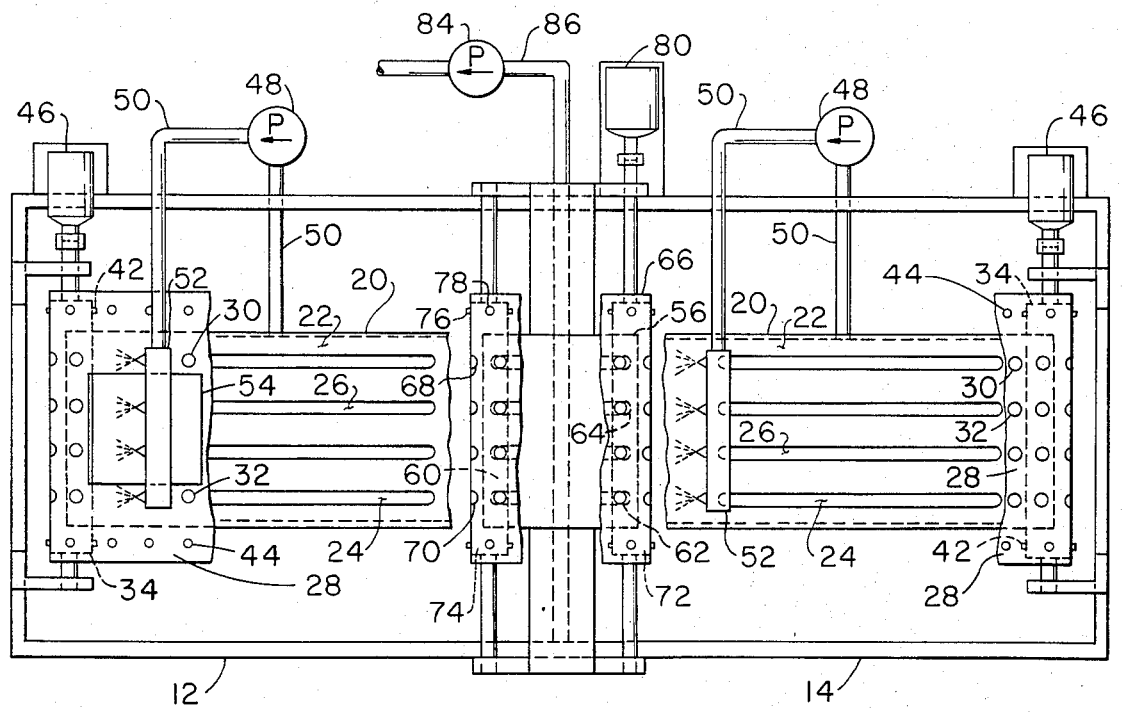
FIG. 2 is a top view of FIG. 1 taken along line II—II of FIG. 1.

Referring to the drawings, and particularly to FIGS. 1 and 2, there is illustrated an apparatus generally designated by the numeral 10 for conveying a flexible, imperforate member, such as a photographic material, through a plurality of liquids.

Apparatus 10 shown in FIGS. 1 and 2 includes containers 12 and 14. While containers 12 and 14 share a common wall 16 as shown in FIG. 1, containers 12 and 14 could be separate containers in other embodiments of the present invention.

Containers 12 and 14 can be made of any suitable material compatible with the liquid and the chemical action to take place therein. In photographic processing, for example, a suitable material for containers 12 and 14 is stainless steel. While only two containers 12 and 14 are shown in FIGS. 1 and 2, a plurality of containers could be used in an apparatus of the present invention for conveying a flexible, imperforate member, such as a photographic material, through a plurality of liquids.

Container 12 has a liquid 18 therein. In photographic processing, for example, liquid 18 could be any number of liquids, such as a developer, a bleach fix, or a wash liquid.

Support member 20 is positioned in container 12 in liquid 18 therein. Support member 20 is preferably hollow. The composition of support member 20 can be of any suitable material compatible with the liquid and chemical action to take place therein. In photographic processing, an example of a suitable material for support member 20 is stainless steel.

Support member 20 has a surface 22 with a pervious portion 24, as shown in FIG. 2. Preferably, the pervious portion 24 of support member 20 includes a plurality of elongated, longitudinally extending slots 26 which are illustrated in greater detail in FIG. 3.

Flexible carrier member or endless belt 28 is positioned in overlying relation with surface 22 of support member 20. Flexible carrier member 28 has a pervious portion 30, as shown in FIG. 2. Preferably, pervious portion 30 includes a plurality of apertures 32. The apertures 32 are in alignment with elongated, longitudinally extending slots 26 of support member surface 22. Such alignment is illustrated in greater detail in FIG. 3. Additionally, it can be seen from FIGS. 2 and 3, that certain of apertures 32 are in alignment with certain of the elongated, longitudinally extending slots 26.

While the flexible carrier member 28 is shown in FIGS. 1 and 2 as an endless belt, in other embodiments of the present invention the flexible carrier member 28 need not be an endless belt, depending upon the particular use, application, and embodiment of the invention. In most instances, an endless belt is preferred for flexible carrier member 28.

Flexible carrier member 28 should be composed of a material suitable for the particular application in which it will be used in the apparatus of the present invention. In photographic processing, for example, it is desirable that flexible carrier member 28 be fabricated of a thin, plastic material, such as polyvinylchloride.

A shown in FIGS. 1 and 2, rollers 34, 36, 38, and 40 function to convey flexible carrier member 28 in abutting relation with support member surface 22. With this arrangement the pervious portion 30 of flexible carrier member 28 is in overlying relation with pervious portion 24 of support member surface 22. Rollers 34 and 36 have pin-type bear teeth 42 which mate with perforations 44 in flexible carrier member 28. An electric motor 26 is engaged to roller 34 and drives roller 34 to convey flexible carrier member 28 in the manner as previously discussed therein. While a single electric motor 46 is shown in FIG. 2 for driving roller 34 to convey flexible carrier member 28, an additional motor may be used to drive roller 36. In an additional electric motor is used, it is preferable that the two electric motors be synchronized with each other.

While the motor or motors can be located on any of rollers 34, 35, 38, or 40, it is desirable that the motor or motors be located on rollers 34 or 36. An electric motor 46 is illustrated in FIG. 2 for driving roller 34 to convey flexible carrier member 28. In the alternative, any other known apparatus can be used for driving a roller or rollers to convey flexible carrier member 28.

In the embodiment sbown in FIGS. 1 and 2, rollers 36, 38, and 40 are idler rollers which freely rotate and serve to guide flexible carrier member 28 as it is conveyed in abutting relation with surface 22 of support member 20. Rollers 34, 36, 38, and 40, and electric motor 46 are appropriately mounted to container 12, as for example, by brackets or the like.

Rollers 34, 36, 38, and 40, and electric motor 46, as shown in FIGS. 1 and 2, are illustrative of a typical way which may be employed with an apparatus of the present invention for conveying flexible carrier member 28. Other suitable ways for conveying flexible carrier member 28 are possible, depending upon the use, operation, and the particular embodiment of the apparatus of the present invention.

In FIGS. 1 and 2, a suction pump 48 is connected to pervious portion 24 of support member surface 22 by means of a conduit 50. Suction pump 48 applies a suction through pervious portion 24 of support member surface 22 and through pervious portion 30 of flexible carrier member 28. The pervious portion 30 is in overlying relation with pervious portion 24. Conduit 50 of FIGS. 1 and 2 also functions to return any liquid 18 to container 12, which was pulled by the suction from suction pump 48 through pervious portion 24 of support member surface 22.

Desirably, where a flexible, imperforate member, such as a photographic material, would enter liquid 18 in container 12, a nozzle 52 or other spraying device may be provided for spraying any liquid 18 which was drawn by the suction of suction pump 48 onto a flexible, imperforate member, such as a photographic material, as it enters liquid 18 on flexible carrier member 28. In FIGS. 1 and 2, nozzle 52 is located at one end of conduit 50 and the pervious portion 24 of support member surface 22 is located at the opposite end of conduit 40. Nozzle 52 is positioned over flexible carrier member 28 in the area where a flexible, imperforate member such as a photographic material, would enter liquid 18. Such spraying may assist with engaging a flexible, imperforate member, such as a photographic material, to flexible carrier member 28, as well as commencing the appropriate chemical action on such flexible, imperforate member.

Figure 3:
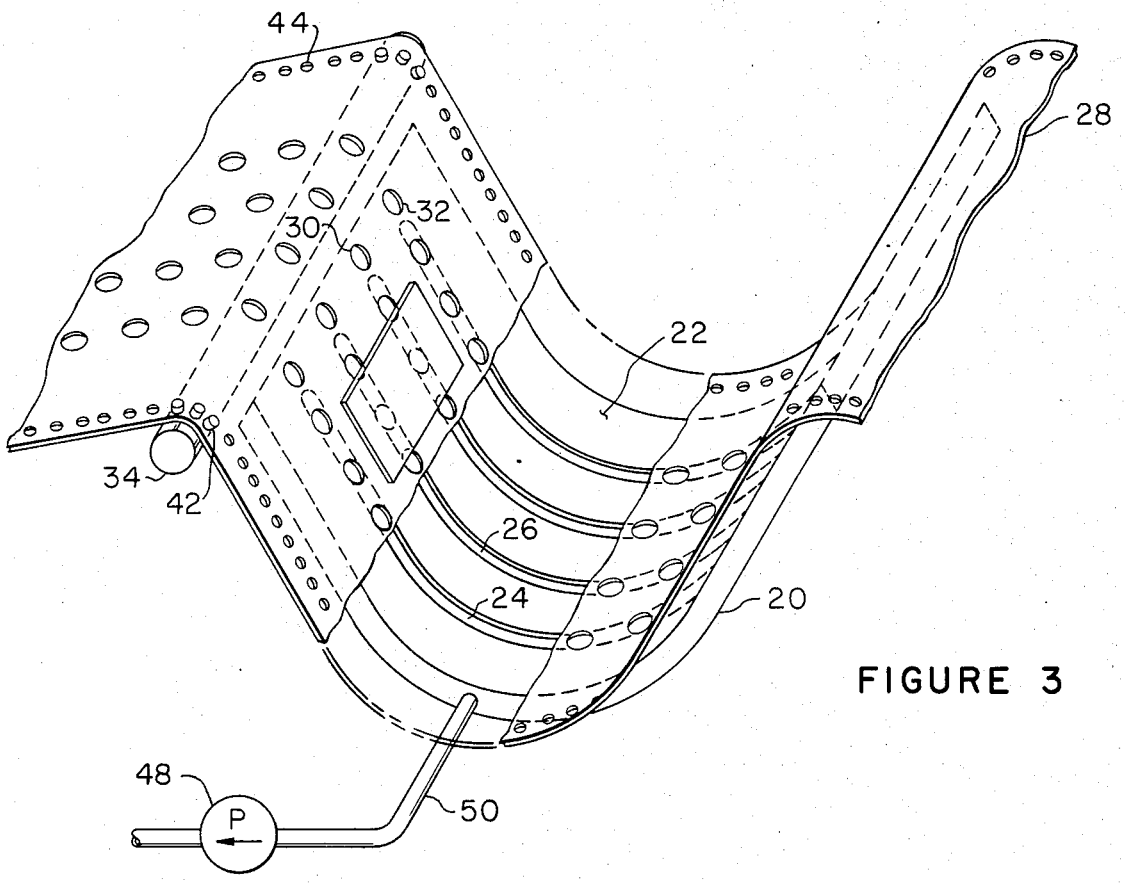
FIG. 3 is a perspective view of a "U-shaped" support member with a flexible carrier member positioned thereon.

FIG. 3 is a perspective view showing, in greater detail, support member 20 and flexible carrier member 28. As can be seen from FIG. 3, support member 20 has a generally U-shaped configuration. Such U-shaped configuration for support member 20 is generally desirable for photographic processing applications. Other configurations are possible for support member 20, depending upon the particular use and application.

Flexible carrier member 28, as shown in FIG. 3, is positioned in overlying relation with support member surface 22. The apertures 32 of flexible carrier member 28 are aligned with elongated, longitudinally extending slots 26 of support member surface 22. FIG. 3 also shows suction pump 48 in conduit 50. Additionally, roller 34 is shown with pin-type gear teeth 42 mating with perforations 44 in flexible carrier member 28.

Referring to FIGS. 1 and 2, in conveying a flexible, imperforate member, such as a photographic material, through liquid 18 in container 12, a flexible, imperforate member 54, such as a flexible, impervious photographic material, is positioned on flexible carrier member 28 in the area of roller 34. Motor 46 and suction pump 48 are energized to convey flexible carrier member 28 while applying a suction through pervious portion 24 of support member surface 22 and through pervious portion 30 of flexible carrier member 28. Nozzle 52 sprays liquid 18, drawn in by suction pump 48, through pervious portion 24 onto flexible, imperforate member 54 to assist in engaging member 54 to flexible carrier member 28. The suction generated by suction pump 48, through pervious portion 24 and pervious portion 30, engages flexible, imperforate member 54 to flexible carrier member 28. As motor 46 drives roller 34, flexible carrier member 28 with flexible, imperforate member 54 engaged thereto by the suction from pump 48 is conveyed along surface 22 of support member 20 through liquid 18 exiting liquid 18 in the area of roller 36.

Figure 4:
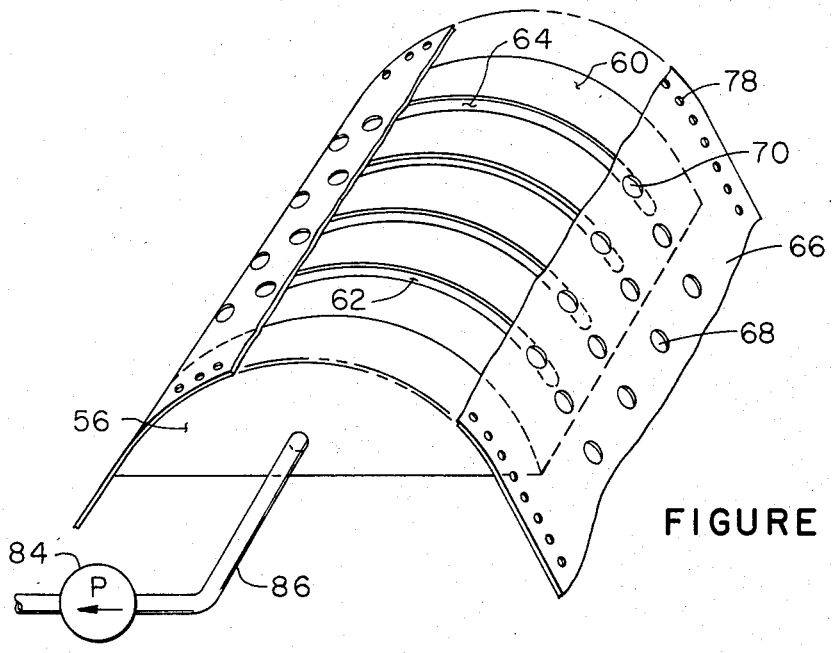
FIG. 4 is a perspective view of a transfer member with a flexible carrier member positioned thereon.

Referring to FIGS. 1 and 2, a transfer member 56, illustrated in greater detail in FIG. 4, is positioned adjacently between containers 12 and 14. Transfer member 56 is arranged for transferring flexible, imperforate member 54, such as a photographic material, from liquid 18 in container 12 to liquid 58 in container 14. Transfer member 56 has a surface 60 with a pervious portion 65. Preferably, pervious portion 62 includes a plurality of elongated, longitudinally extending slots 64. While only a single transfer member 56 is shown in FIGS. 1 and 2, a plurality of transfer members may be employed, depending upon the number of containers having a liquid therein required for a particular process, such as a photographic process.

A flexible carrier member 66, shown in detail in FIG. 4, is positioned in overlying relation with transfer member surface 60. Flexible carrier member 66 has a pervious portion 68. The pervious portion 68 includes a plurality of apertures 70. Flexible carrier member 66 is, preferably, an endless belt, as is shown in FIG. 1 but other than an endless belt may be used.

Rollers 72 and 74 convey flexible carrier member 66 in abutting relation with surface 60 of transfer member 56, such that pervious portion 68 of flexible carrier member 66 is in overlying relation with pervious portion 62 of transfer member surface 60.

Rollers 72 and 74, as shown in FIGS. 1 and 2, have pin-type gear teeth 76 which mate with perforations 78 in flexible carrier member 66.

An electric motor 80, as shown in FIG. 2, engages roller 72 to drive roller 72 and convey flexible carrier member 66 over surface 60 of transfer member 56. While in the embodiments shown in FIGS. 1 and 2, roller 72 is an idler roller, an additional motor may also engage roller 72 in other embodiments of the present invention, where appropriate. If an additional electric motor is used, it is preferable that such electric motors be synchronized with each other. Additionally, electric motor 80 is an example of one type of device to drive a roller or rollers which convey flexible carrier member 66 over surface 60 of transfer member 56.

In the embodiments shown in FIGS. 1 and 2, transfer member 56 is suitably mounted to common wall 16 of tanks 12 and 14, such as being mounted on an extension member 82, which is mounted by brackets to wall 16. Rollers 72 and 74 can also be mounted by brackets or the like to extension member 82, as shown in FIG. 1, or can be mounted directly to wall 16. Electric motor 80 is mounted in a conventional manner, such as by brackets or the like, to extension member 82, or mounted to wall 16 by brackets or the like.

A suction pump 84 applies a suction by means of a conduit 86 through pervious portion 62 of transfer member 56 and through pervious portion 68 of flexible carrier member 66. Referring to FIG. 4, transfer member 56 and flexible carrier member 66 are illustrated in greater detail. Transfer member 56 has a generally semi-cylindrical configuration. Such semi-cylindrical configuration is generally preferred for photographic processing. Other configurations for transfer member 56 are possible, depending upon the particular application and embodiment of the invention. Additionally, transfer member 56 is composed of a material suitable for the particular application for which it will be used. In photographic processing, an example of a suitable material for transfer member 56 is stainless steel.

As seen in FIG. 4, a plurality of elongated, longitudinally extending slots 64 extend over transfer member surface 60. The slots 64 are shown in alignment with apertures 70 of flexible carrier member 66. Flexible carrier member 66 is fabricated of a material suitable for the particular application for which it will be used. In photographic processing, for example, it is desirable that flexible carrier member 66 be fabricated of a thin, plastic material, such as polyvinylchloride. Suction pump 84 is connected to conduit 86. Perforations 78 are provided in flexible carrier member 66 which mate with pin-type gear teeth 76.

Referring to FIGS. 1 and 2, as flexible, imperforate member 54, such as a photographic material, exits liquid 18 and is conveyed from flexible carrier member 28 onto flexible carrier member 66, motor 80 is energized and suction pump 84 is activated. Motor 80 drives roller 72 which conveys flexible carrier member 66. Flexible carrier member 66 is positioned in abutting relation with surface 60 of transfer member 56 and flexible, imperforate member 54 is engaged to flexible carrier member 66 by the suction generated from suction pump 84 through pervious portion 62 of transfer member surface 60 and through pervious portion 68 of flexible carrier member 66. Flexible, imperforate member 54 is conveyed from liquid 18 in container 12 to liquid 58 in container 14, exiting from flexible carrier member 66 in the area of roller 72.

Regarding tank 14 shown in FIGS. 1 and 2, tank 14 is identical in construction to tank 12. Liquid 58 in tank 14 may or may not be the same as liquid 18 in tank 12, depending upon the particular chemical process. The support member, the flexible carrier member, the rollers, the suction pump, conduit associated with the suction pump, and the nozzle at the terminal end of the conduit, and the motor which drives a roller associated with tank 14 are substantially identical with that previously discussed in regard to similar apparatus associated with tank 12. As such, the numbering of such members and devices associated with tank 14 is the same as the numbering of the related members and devices in tank 12. The function of such members and devices and their manner of operation is as previously discussed with regard to such members and devices in relation to tank 12.

With regard to tank 14, when motor 46 is energized and drives roller 34 and when suction pump 48 is activated, flexible, imperforate member 54 is conveyed from flexible member 66 onto flexible carrier member 28 into tank 14. Flexible, imperforate member 54, such as a photographic material, is conveyed with flexible carrier member 28 in tank 14 through liquid 58 in abutting relation with support member surface 22, and exits liquid 58 in the area of roller 34 associated with tank 14. At this point, in the embodiment shown in FIGS. 1 and 2, flexible, imperforate member 54 can be removed from flexible carrier member 28 associated with tank 14 in any conventional manner.

Figure 5:
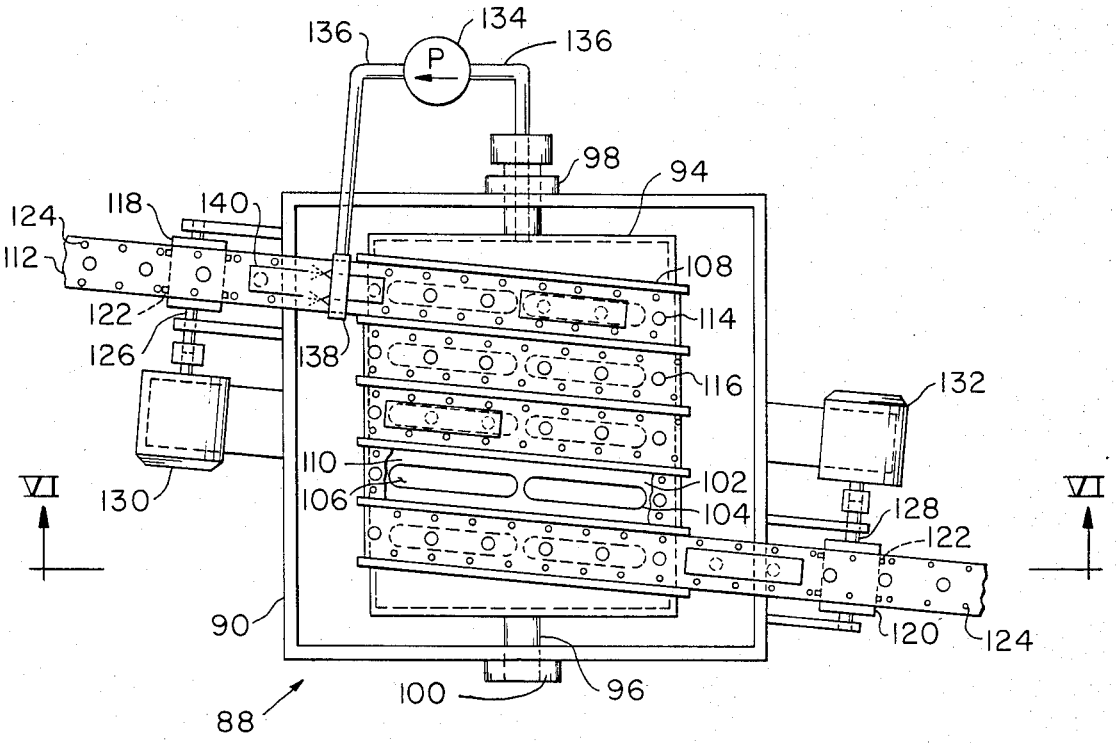
FIG. 5 is a top view showing a alternative embodiment of the present invention wherein the support member has a generally cylindrical configuration.
Figure 6:
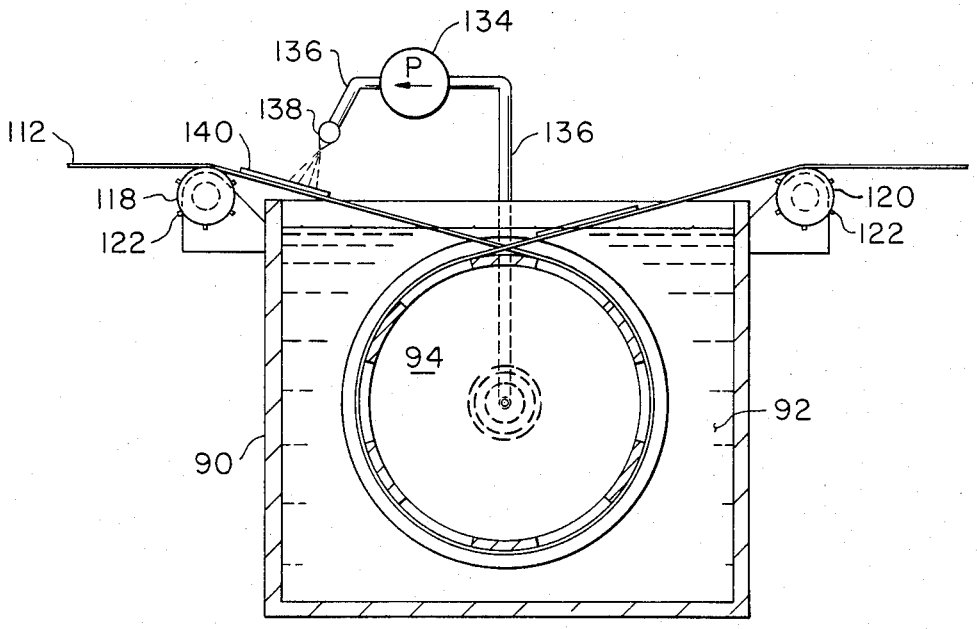
FIG. 6 is an elevational section taken along line VI—VI of FIG. 5.

FIGS. 5 and 6 show an alternative embodiment of the present invention for conveying a flexible, imperforate member, such as a photographic material, through a liquid. The apparatus 88 includes a container 90 having a liquid 92 therein. A support member 94 having a generally cylindrical configuration is horizontally positioned in liquid 92 in container 90. A cylindrical support member 94 has a shaft 96 centrally located through support member 94. At one end, shaft 96 is rotatably mounted by a union 98 on container 90. At the opposite end, shaft 96 is journaled in a bearing 100. Bearing 100 is mounted on the wall of container 90 opposite the wall on which union 98 is mounted. While it is preferred that support member 94 be freely rotatable, support member 94 may, in certain embodiments, be maintained in a fixed position relative to container 90 or, in other embodiments, may be driven by a motor, for example.

Support member 94, in FIGS. 5 and 6, is composed of a material suitable for the particular application for which it will be used. In photographic processing, it is desirable that support member 94 be composed of stainless steel, for example. Support member 94 has a surface 102 having a pervious portion 104. Preferably, pervious portion 104 includes a plurality of apertures 106 disposed in a helical configuration over a substantial portion of support member surface 102, as is shown in FIG. 5. Preferably, support member surface 102 has spiral shaped ridges 108 over a substantial portion thereof, as shown in FIG. 5. Such ridges 108 provide a recessed area 110 for conveying therebetween a flexible carrier member 112 over support member surface 102.

Flexible carrier member 112 has a pervious portion 114. Preferably, pervious portion 114 comprises a plurality of apertures 116, as shown in FIG. 5. Apertures 116 of pervious portion 114 may be different from apertures 106 of the pervious portion 104 of support member surface 102, as shown in FIG. 5. A portion of flexible carrier member 112 is "broken away" for ease of illustration. In photographic processing, for example, it is desirable that flexible carrier member 112 be fabricated of a thin, plastic material, such as polyvinylchloride. As seen in FIG. 5, apertures 106 of pervious portion 104 of support member surface 102 are disposed in a helical configuration in recessed area 110 between ridges 108.

In FIGS. 5 and 6, apparatus 88 further includes rollers 118 and 120. Rollers 118 and 120 have pin-type gear teeth 122 which mate with perforations 124 of flexible carrier member 112. Rollers 118 and 120 are disposed on shafts 126 and 128, respectively. Shafts 126 and 128 are engaged to electric motors 130 and 132, respectively. Motors 130 and 132 drive rollers 118 and 120, respectively. It is preferred that electric motors 130 and 132 be synchronized with each other. While a single motor may be used, two motors are shown in FIGS. 5 and 6.

In the embodiment shown in FIGS. 5 and 6, shafts 126 and 128 and electric motors 130 and 132 are appropriately mounted to container 90 by conventional means, such as by brackets or other suitable mounting members. Rollers 118 and 120, which are engaged to motors 130 and 132, respectively, convey flexible carrier member 112 in liquid 92 in abutting relation with support member surface 102 in recessed area 110. The flexible carrier member pervious portion 114 is positioned in overlying relation with support member surface pervious portion 104. Rollers 118 and 120 and electric motors 130 and 132 serve as an example of one arrangement for conveying flexible carrier member 112 over support member surface 102. Other suitable ways of conveying flexible carrier member 112 may be employed, depending upon the particular use, application, and the embodiment of the invention.

A suction pump 134 applies a suction through pervious portion 104 of support member surface 102 and through pervious portion 114 of flexible carrier member 112 by means of a conduit 136. Conduit 136 is also operable to return any liquid 92 to container 90 which was drawn by the suction from suction pump 134 through pervious portion 104 of support member surface 102.

Desirably, a nozzle 138, or other suitable spraying device, may be provided for spraying liquid 92 which was drawn by suction pump 134 through pervious portion 104 of support member surface 102 onto a flexible, imperforate member 140, such as a photographic material, as it enters liquid 92 on flexible carrier member 112. Nozzle 138 is located at the end of conduit 136 and is positioned over flexible carrier member 112 in the area where flexible, imperforate member 140 enters liquid 92. Such spraying assists with engaging flexible, imperforate member 140 to flexible carrier member 112, as well as commencing the appropriate chemical action on flexible, imperforate member 140.

In conveying flexible, imperforate member 140, such as a photographic material, through liquid 92, flexible, imperforate member 140 is placed on flexible carrier member 112 by any conventional means. Suction pump 134 and motors 130 and 132 are energized. Energizing suction pump 134 draws suction through pervious portion 104 of the surface 102 and through pervious portion 114 of flexible carrier member 112, causing liquid 92 to flow through conduit 136 and through nozzle 138 spraying liquid 92 on flexible, imperforate member 140 to assist in engaging member 140 on a flexible carrier member 112. Suction from suction pump 134 also engages flexible, imperforate member 140 to flexible carrier member 112, as flexible carrier member 112 is conveyed in abutting relation to support member surface 102 in recessed area 110 as rollers 118 and 120 are driven by electric motors 130 and 132. Such driving of rollers 118 and 120 and suction generated by suction pump 134 convey flexible, imperforate member 140 with flexible carrier member 112 over support member surface 102 in and through recessed area 110 with flexible, imperforate member 140 exiting liquid 92 in the area of roller 120. Desirably, in making such conveyance, flexible carrier member 112 is an endless belt which is wrapped around support member 94 on support member surface 102 in recessed area 110, as shown in FIGS. 5 and 6. Flexible carrier member 112 is "broken away" in the area of rollers 118 and 120 for ease of illustration.

Figure 7:
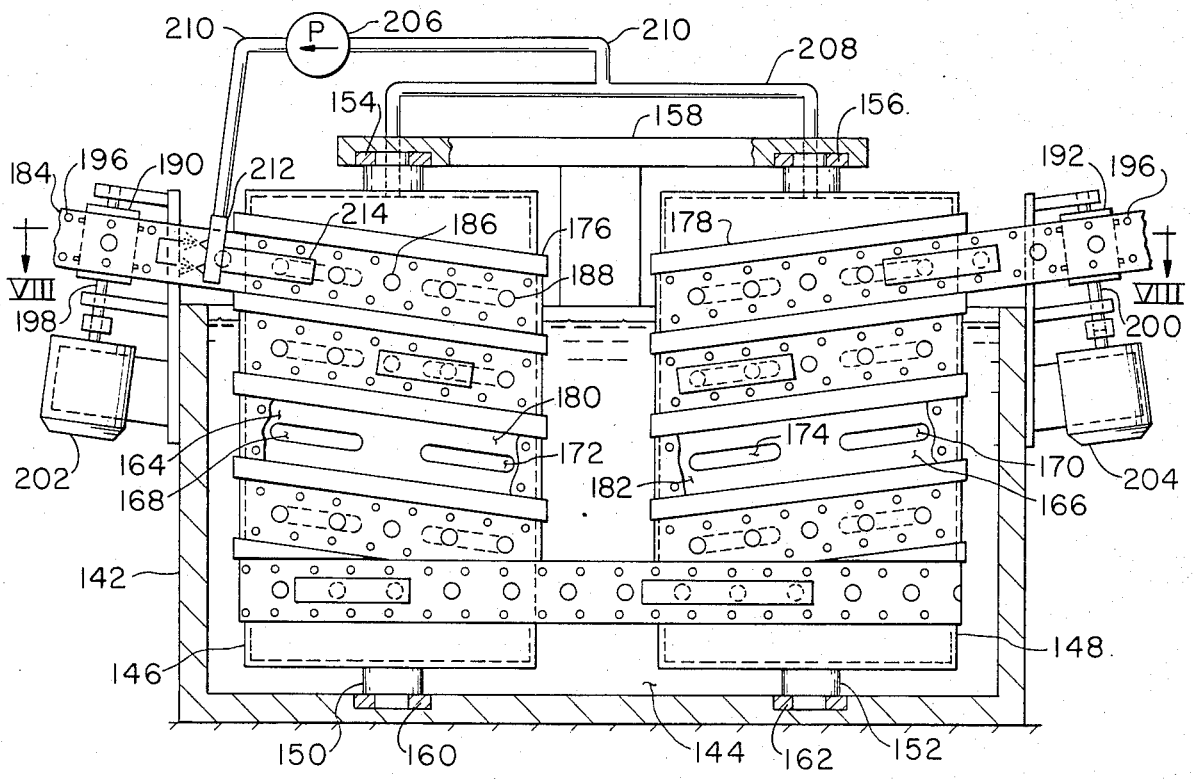
FIG. 7 is a side elevational view of another embodiment of the present invention wherein two support members having a generally cylindrical configuration are employed with the container shown in section.
Figure 8:
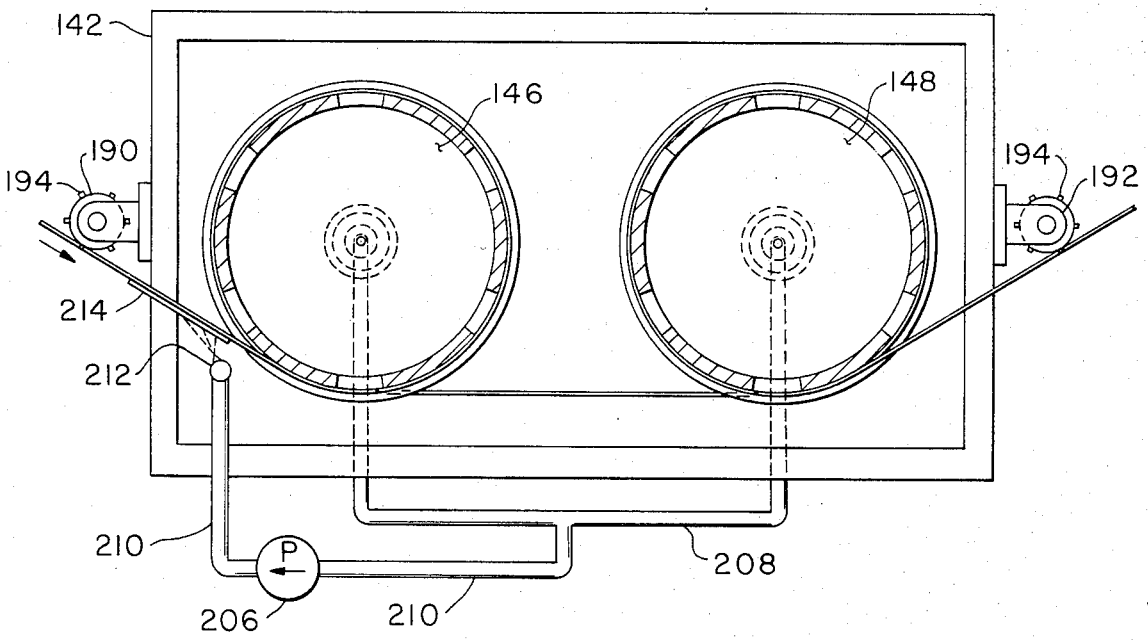
FIG. 8 is a sectional top view taken along line VIII—VIII of FIG. 7.

FIGS. 7 and 8 illustrate another alternative embodiment of the present invention for conveying a flexible, imperforate member, such as a photographic material, through a liquid. The apparatus shown in FIGS. 7 and 8 includes a container 142 having a liquid 144 therein.

A support member 146 and a support member 148, each having a generally cylindrical configuration are vertically positioned in liquid 144 of container 142. Cylindrical support members 146 and 148 have shafts 150 and 152, respectively, centrally located therethrough. Shafts 150 and 152 are rotatably mounted by unions 154 and 156, respectively. Unions 154 and 156 are mounted in a conventional manner in extension member 158. Extension member 158 is conventionally mounted to container 142. The other end of shafts of 150 and 152 are rotatably mounted in the bottom wall of container 142 by bearings 160 and 162, respectively. While it is preferred that support members 146 and 148 be freely rotating, support members 146 and 148 may, in certain embodiments, be driven by a driving device, such as an electric motor.

Support members 146 and 148 are fabricated of a material suitable for the particular application in which such members will be used. In photographic processing, a suitable material for support member 146 and 148 is stainless steel. Support members 146 and 148 have surfaces 164 and 166, respectively, which include pervious portions 168 and 170, respectively. Preferably, pervious portions 168 and 170 include a plurality of apertures 172 and 174, disposed in a helical configuration over a substantial portion of support member surfaces 164 and 166, respectively, as shown in FIG. 7.

Preferably, surfaces 164 and 166 have spiral shaped ridges 176 and 178 over a substantial portion thereof, as shown in FIG. 7. Such ridges 176 and 178 provide recessed areas 180 and 182 for conveying therebetween a flexible carrier member over surfaces 164 and 166 of support members 146 and 148, respectively. As can be seen from FIG. 7, apertures 172 and 174 are disposed in a helical configuration in recessed areas 180 and 182 between ridges 176 and 178, respectively.

Flexible carrier member 184 has a pervious portion 186. Preferably, pervious portion 186 includes a plurality of apertures 188. Apertures 188 of pervious portion 186 may be different from apertures 172 and 174 of pervious portions 168 and 170, respectively. Desirably, flexible carrier member 184 is an endless belt which is wrapped around support member 146 on support member surface 164 in recessed area 180 and is wrapped around support member 148 on support member surface 166 in recessed area 182. As shown in FIGS. 7 and 8, flexible carrier member 184 is "broken away" on support members 146 and 148 and also in the area that flexible carrier member 184 enters and exits liquid 144.

Flexible carrier member 184 is fabricated of a material suitable for the particular application for which it will be used. In photographic processing, for example, it is desirable that flexible carrier member 184 be made of a thin, plastic material, such as polyvinylchloride.

The apparatus of FIGS. 7 and 8 further includes rollers 190 and 192. Rollers 190 and 192 have pin-type gear teeth 194 which mate with perforations 196 of flexible carrier member 184. Rollers 190 and 192 are disposed on shafts 198 and 200, respectively. Shafts 198 and 200 are engaged to electric motors 202 and 204, respectively, which motors 202 and 204 drive rollers 190 and 192, respectively. It is preferred that electric motors 202 and 204 be synchronized with each other. It not, a single motor may be used, although two motors are shown in FIGS. 7 and 8.

In the embodiment shown in FIGS. 7 and 8, shafts 198 and 200 and electric motors 202 and 204 are appropriately mounted to container 142 by conventional means, such as by brackets or other suitable mounting members. Rollers 190 and 192 which are engaged to motors 202 and 204, respectively, convey flexible carrier member 184 in liquid 144 in abutting relation with support member surface 164 and 166 in recessed areas 180 and 182. This is accomplished with flexible carrier member pervious portion 186 positioned in overlying relation with pervious portions 168 and 170 of support member surfaces 164 and 166, respectively.

Rollers 190 and 192 and electric motors 202 and 204 serve as an example of a possible way for conveying flexible carrier member 184 over support member surfaces 164 and 166. Other suitable ways of so conveying flexible carrier member 184 may be employed, depending upon the particular use, application, and the embodiment of the invention.

A suction pump 206 applies suction through pervious portion 168 of support member surface 164, pervious portion 170 of support member surface 166, and pervious portion 186 of flexible carrier member 184 by means of a conduit 208. Conduit 208 is connected to conduit 210, and conduit 210 is connected to suction pump 206. Conduits 208 and 210 also function to return to container 142 and liquid 144 which was drawn by the suction pump 206 through pervious portions 168 and 170 of support member surfaces 164 and 166, respectively.

Desirably, a nozzle 212, or other suitable spraying device, may be provided for spraying liquid 144 which was drawn by suction pump 206 through pervious portions 168 and 170 of support member surfaces 164 and 166, respectively, onto a flexible, imperforate member 214, such as a photographic material, as it enters liquid 144 on flexible carrier member 184. Nozzle 212 is located at the end of conduit 210 and is positioned in the area where flexible, imperforate member 214 enters liquid 144. Such spraying assists with engaging flexible, imperforate member 214 to flexible carrier member 148, as well as commencing the appropriate chemical action on flexible, imperforate member 214.

In conveying flexible, imperforate member 214, such as a photographic material, through liquid 142, flexible, imperforate member 214 is placed on flexible carrier member 184 by conventional means. Suction pump 206 and motors 202 and 204 are energized. Energizing suction pump 206 draws a suction through pervious portion 168 of support member surface 164, through pervious portion 170 of support member surface 166 and through pervious portion 186 of flexible carrier member 184, causing liquid 144 to flow through conduits 208 and 210, and through nozzle 212. Spraying liquid 144 on flexible, imperforate member 214 assists in engaging member 213 on flexible carrier member 184. Suction from suction pump 206 also engages flexible, imperforate member 214 to flexible carrier member 184. Flexible carrier member 184 is conveyed in abutting relation with support member surface 164 in recessed area 180 and with support member surface 166 in recessed area 182 as rollers 190 and 192 are driven by electric motors 202 and 204, respectively. Rotation of rollers 190 and 192 and the suction generated by suction pump 206 convey flexible, imperforate member 214 with flexible carrier member 184 over support member surfaces 164 and 166 in and through recessed areas 180 and 182, respectively, with flexible, imperforate member 214 exiting liquid 144 in the area of roller 192.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for conveying a photographic material through a liquid in photographic processing comprising, a container having a liquid therein, a support member having a generally U-shaped configuration positioned in said liquid in said container, said support member having a surface with a pervious portion and said pervious portion of said surface of said support member including a plurality of elongated, longitudinally extending slots, a flexible carrier member positioned in overlying relation with said support member surface, said flexible carrier member having a pervious portion, conveying means for conveying said flexible carrier member in said liquid in abutting relation with said surface of said support member with said carrier pervious portion in overlying relation with said support member pervious portion, suction means for applying a suction through said pervious portion in said support member surface and through said pervious portion in said flexible carrier member in overlying relation therewith, and said flexible carrier member arranged to engage a surface of a flexible, impervious photographic material by said suction through said pervious portion of said flexible carrier member, and thereby convey said flexible, impervious photographic material with said flexible carrier member on said surface of said support member.

2. The apparatus as set forth in claim 1 wherein, said flexible carrier member pervious portion is in overlying relation with certain of said elongated, longitudinally extending slots.

3. The apparatus as set forth in claim 1 wherein, said pervious portion of said flexible carrier member includes a plurality of apertures, said apertures being in overlying relation with said pervious portion of said support member surface.

4. Apparatus for conveying a photographic material through a liquid in photographic processing comprising, a container having a liquid therein, a support member having a generally cylindrical configuration positioned in said liquid in said container, said support member having a surface with a pervious portion, said pervious portion of said surface of said support member including a plurality of apertures disposed in a helical configuration over a substantial portion of said surface, said surface of said support member having spiral shaped ridges over a substantial portion thereof to provide a recessed area between pairs of said ridges for conveying a flexible carrier member therebetween over said surface, said plurality of apertures being disposed in a helical configuration in said recessed area between said ridges, a flexible carrier member positioned in overlying relation with said support member surface, said flexible carrier member having a pervious portion, conveying means for conveying said flexible carrier member in said liquid in abutting relation with said surface of said support member with said carrier pervious portion in overlying relation with said support member pervious portion, suction means for applying a suction through said pervious portion in said support member surface and through said pervious portion in said flexibile carrier member in overlying relation therewith, and said flexible carrier member arranged to engage a surface of a flexible, impervious photographic material by said suction through said pervious portion of said flexible carrier member, and thereby convey said flexible, impervious photographic material with said flexible carrier member on said surface of said support member.

5. The apparatus as set forth in claim 4 wherein, at least two of said support members have a generally cylindrical configuration, are positioned in said liquid in said container, each of said support members having a surface with a pervious portion, said flexible carrier member is positioned in overlying relation with each said support member surface, said conveying means conveys said flexible carrier member in said liquid in abutting relation with said surface of each of said support members with said flexible carrier member pervious portion in overlying relation with said support member surface pervious portion for each said support members, and suction means for applying a suction through said pervious portion of said surface of each of said support members and through said pervious portion of said flexible carrier member in overlying relation therewith to convey said flexible, impervious photographic material with said flexible carrier member on said surface of each said support member.

6. Apparatus for conveying a photographic material through a plurality of liquids in photographic processing comprising, a plurality of containers each having a liquid therein, a support member having a generally U-shaped configuration positioned in the liquid in each container, said support member having a surface with a pervious portion and said pervious portion of said surface of said support member including a plurality of elongated, longitudinally extending slots, transfer means positioned between each of said plurality of containers for transferring flexible, impervious photographic material from one container to an adjacent container, said transfer means having a surface with a pervious portion, said transfer means surface having an arcuate configuration and said pervious portion of said surface of said transfer means including a plurality of elongated, longitudinally extending slots, a flexible carrier means positioned in overlying relation with said support member surface and said surface of said transfer means, said flexible carrier means having a pervious portion, conveying means for conveying said flexible carrier means in abutting relation with said surface of said support members and with said surface of said transfer means, with said flexible carrier means pervious portion in overlying relation with said support member pervious portion and with said transfer means surface pervious portion, suction means for applying a suction through said pervious portions of said surfaces of said support members, through said pervious portion of said surface of said transfer means, and through said pervious portion of said flexible carrier means in overlying relation therewith, and said flexible carrier means being arranged to engage a surface of a flexible, impervious photographic material by suction through said pervious portion of said flexible carrier means and thereby convey said flexible, impervious photographic material with said flexible carrier means on said surface of said support members and on said surface of said transfer means to convey said flexible, impervious photographic material through said liquid in said plurality of containers.

7. A method for transporting photographic material through a liquid bath comprising, positioning a support member having a generally cylindrical configuration in a container of liquid, said support member having a surface with spiral shaped ridges over a substantial portion thereof to provide a recessed area between said ridges and having a plurality of apertures disposed in a helical configuration in said recessed area on said surface, positioning a flexible carrier member having a pervious portion in overlying relation with said surface of said support member in said recessed area, positioning a flexible, impervious photographic material on said flexible carrier member, applying a suction through said apertures of said support member surface and through said pervious portion of said flexible carrier member to engage said flexible, impervious photographic material on said flexible carrier member by said suction, and conveying said flexible carrier member with said flexible, impervious photographic material engaged thereto on said surface of said support member in said recessed area through said liquid.

8. A method for transporting photographic material through a liquid bath comprising, positioning a support member having a U-shaped configuration in a container of liquid, said support member having a surface with a plurality of elongated, longitudinally extending slots therein, positioning a flexible carrier member having a pervious portion in overlying relation with said surface of said support member, positioning a flexible, impervious photographic material on said flexible carrier member, applying a suction through said elongated, longitudinally extending slots of said surface of said support member and through said pervious portion of said flexible carrier member to engage said flexible, impervious photographic material on said flexible carrier member by said suction, and conveying said flexible carrier member with said flexible, impervious photographic material engaged thereon on said surface of said support member through said liquid.

* * * * *